US005680954A

United States Patent [19]

Arnold et al.

[11] Patent Number: 5,680,954

[45] Date of Patent: Oct. 28, 1997

[54] OIL FILL CAP

[75] Inventors: Stephen M. Arnold, North Vernon, Ind.; Ron Boss, Santa Fe Springs, Calif.; Russ R. Henney, Columbus, Ind.

[73] Assignee: Cummins Engine Company, Inc., Columbus, Ind.

[21] Appl. No.: 585,739

[22] Filed: Jan. 16, 1996

Related U.S. Application Data

[63] Continuation of Ser. No. 288,048, Aug. 10, 1994, abandoned.

[51] Int. Cl.[6] ..... B65D 41/06

[52] U.S. Cl. ..... 220/300; 220/212.5; 220/295; 220/304; 215/214; 215/330; 215/331; 215/356

[58] Field of Search ..... 220/212.5, 281, 220/293, 295, 296, 297, 300, 301, 304, 307, DIG. 32, DIG. 33, 789; 215/213, 214, 220, 222, 330, 331, 335, 341, 354, 356, 357

[56] References Cited

U.S. PATENT DOCUMENTS

| | | | |
|---|---|---|---|
| 296,876 | 4/1884 | Rosenzi . | |
| 1,457,418 | 6/1923 | Baldwin . | |
| 3,739,933 | 6/1973 | Degaetano | 215/222 |
| 3,913,783 | 10/1975 | Cooper | 220/304 X |
| 3,927,783 | 12/1975 | Bogert | 215/222 |
| 4,119,232 | 10/1978 | Thornton | 215/222 |
| 4,387,817 | 6/1983 | Wiles et al. | 215/222 X |
| 4,717,119 | 1/1988 | Trin | 220/300 X |
| 5,071,020 | 12/1991 | Reutter | 220/301 X |

FOREIGN PATENT DOCUMENTS 2012001 3/1970 Germany .

OTHER PUBLICATIONS

Reference No. 3636, Mardon's Specification dated Sep. 2, 1880 (single sheet).

*Primary Examiner*—Stephen Cronin

*Attorney, Agent, or Firm*—Sixbey, Friedman, Leedom & Ferguson; Charles M. Leedom, Jr.; Donald R. Studebaker

[57] ABSTRACT

A molded cap is disclosed having a sealing ring groove just below the cap handle in order to seal crank case gases in an internal combustion engine. The cap includes two spiral grooves for engaging a respective protrusion formed on the inner annular surface of an oil fill snout which receives the cap. A recess is formed at the end of each spiral groove for receiving a respective protrusion to lock the cap into the oil fill snout. The oil fill snout has a draft angle to provide an outside vertical force component on the cap and sealing ring. The vertical force locks the protrusions into the respective recesses and provides a positive sealing force to the sealing ring when the cap is twisted into the snout and into the closed position. The two spiral grooves increase the resistance to back out and create symmetric force components. At the entrance of each groove, a lead-in angle is used to free the cap from the cover by continuing to turn the cap in a counter-clockwise motion.

16 Claims, 3 Drawing Sheets

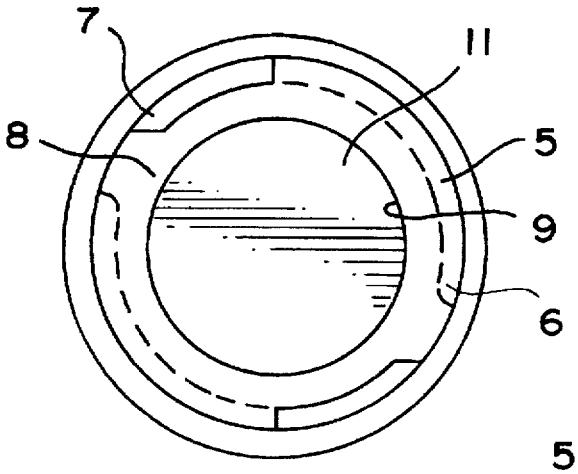
FIG. 5
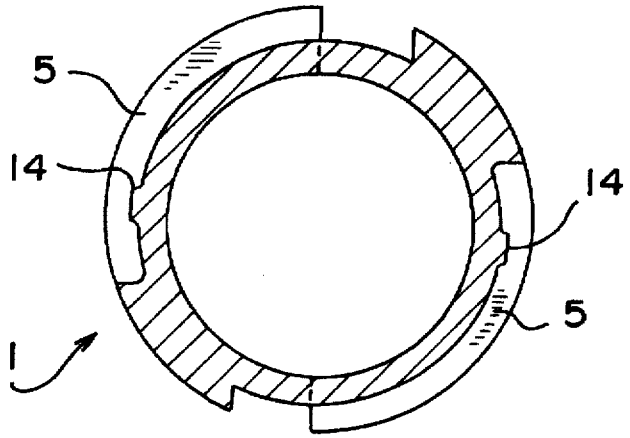
FIG. 6
FIG. 7
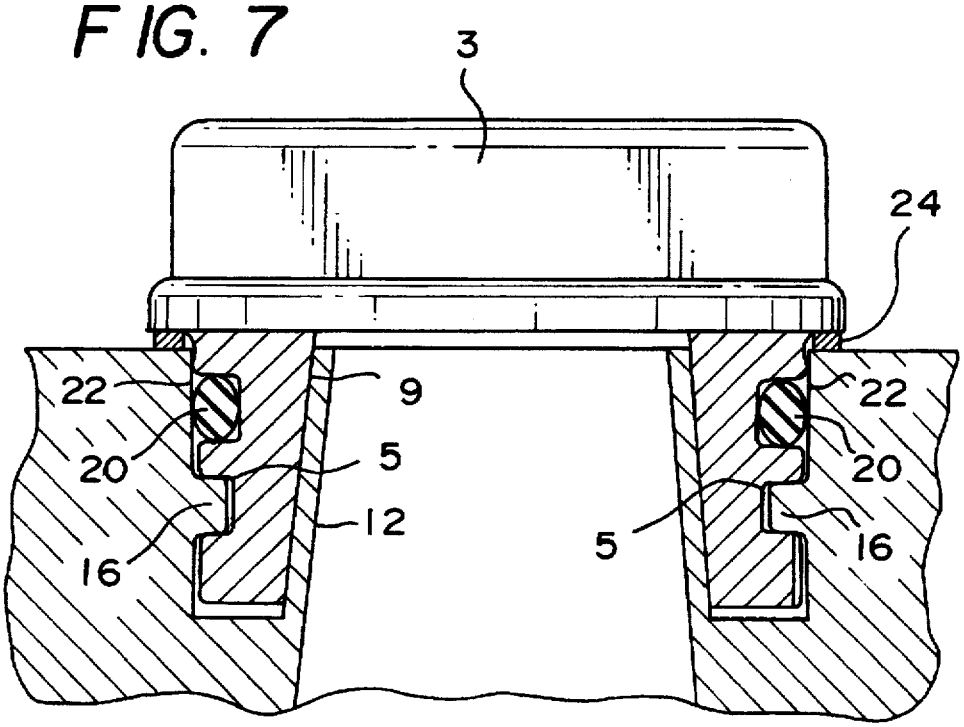

OIL FILL CAP

This application is a Continuation of Ser. No. 08/288,048, filed Aug. 10, 1994, now abandoned.

TECHNICAL FIELD OF THE INVENTION

The present invention relates to a cap and more particularly, to an oil fill cap for effectively sealing a crank case cover used in an internal combustion engine.

BACKGROUND OF THE INVENTION

The use of an oil fill cap for sealing crank case covers in internal combustion engines is well known in the art and, more particularly, caps of this type are known for repeatedly sealing a crank case cover in an internal combustion engine.

A typical oil fill cap is disclosed in German Patent No. 2,012,001. The cap includes a substantially planar top portion and a depending cylindrical threaded portion with a sealing ring being positioned between the top portion and the cylindrical portion form a seal between the cap and the crank case cover. However, during the operation of an internal combustion engine, the engine will vibrate which may lead to the loosening of the cap and ultimately a break in the seal. Further, when removing the cap, the cap must be turned a number of times and "wiggled" free from the crank case cover which, depending upon the positioning of the cap, could require considerable effort.

While not directly related to the sealing of a crank case cover, numerous styles of caps for bottles for accommodating liquids have been designed over the years.

Reference No. 3636 issued to Mardon on Sep. 7, 1880, discloses a bottle stopper which includes two angled grooves formed symmetrically opposite of each other, for receiving a respective protrusion formed on the inner annular surface of the spout of the bottle receiving the stopper. A circumferential groove is also provided below the wide portion of the bottle stopper for receiving a gasket or O-ring. This bottle stopper or cap design, however, may loosen due to vibration because the two angled grooves are not spiral and do not to create a strong seal. Moreover, the throat of the bottle is not angled to impart a vertical component to the O-ring to create a stronger seal and the bottle stopper does not include a lead-in angle at the entrance of the two angled grooves. Clearly, these issues are not of concern in that the bottle which receives the stopper is not subjected to the continuous vibrations which is present in an internal combustion engine.

In another similar stopper type closure, U.S. Pat. No. 296,876 issued to Rosenzi discloses a jar lid with spirally extending grooves positioned on opposite sides of the lid that begin at the bottom neck of the lid and extend upwardly to an overhanging rim at the top of the lid neck. The top of the neck of the lid receives a fitted gasket which is adapted to be compressed by the rim of the lid against the top edge of the mouth of the jar. This lid design, however, does not allow for a seal that can withstand high-gas pressures and does not provide a thread design that breaks the seal and drives the lid completely off of the bottle by continuing to turn the lid counter-clockwise. Further, as with the above noted lid design, these issues are not of concern in that the jar which receives the stopper is not subjected to the continuous vibration which is present in our internal combustion engine.

The creation of a stronger seal between the lid and bottle structure is discussed in U.S. Pat. No. 1,457,418 issued to Baldwin which discloses a wide-mouthed jar with an internally tapered and threaded neck for receiving a cover having a collar with externally segmented threads. The cover further includes a circular gasket which fits circumferentially at the top of the collar which abuts the cover to provide a seal between the cover and the bottle neck. The cover is disengaged from the bottle throat by first pushing the cover inward to free the collar threads and then turning the cover in the proper direction to release it. Although this bottle design comprises a bottle neck that is tapered to receive a cover and thus, imparts a vertical component to the gasket, the cover again is not designed to provide a seal strong enough to withstand high pressure gases found in internal combustion engines, as well as the continuous vibration of such engine. In this regard, the cover does not include any positive locking mechanism to ensure that the cover will not loosen due to vibration and other forces. The lid merely relies on the frictional forces acting between the complimentary threaded surfaces. Moreover, the cover does not include a handle or use lead-in angles to allow for easy closing and removal.

It is evident that there is a need for a simplified cap structure that provides a strong seal and positive locking mechanism to prevent gas leakage and cap loss due to high gas pressures and continuous engine vibration. Furthermore, there is a need for a cap to have lead-in angles which upon rotating the cap counter-clockwise drive the cap upward until the seal is broken and the cap is freed from the container.

SUMMARY OF THE INVENTION

In view of the foregoing, a primary object of the present invention is to overcome the above-noted shortcomings associated with the prior art devices.

It is an object of the present invention to provide a cap that produces a strong seal that is able to withstand high gas pressures and continuous vibration to eliminate gas leakage and cap loss.

It is a further object of the present invention to provide for easy cap removal by including lead-in angles which upon rotating the cap counter-clockwise drive the cap upward until the seal is broken and the cap is freed from the container.

Yet another object of the present invention is to provide a cap which cooperates with a receiving snout of a crankcase cover for providing a positive lock there between in order to maintain the cap in the requisite position until such time as the cap is to be removed.

A further object of the present invention is to provide an oil fill cap wherein the seal between such cap and the receiving snout of the crankcase cover is created within the snout and not outside the snout to ensure a reliable seal against the escape of crankcase gases.

These, as well as other objects of the present invention are achieved by a cap molded with an 'O' ring groove just below the cap handle in order to seal crank case gases under the oil fill cap. The cap includes two spiral grooves for engaging a respective protrusion formed on the inner annular surface of an oil fill snout which receives the cap. A recess is formed at the end of each spiral groove for receiving a respective protrusion formed in the oil fill snout to lock the cap into the snout. The oil fill snout further includes a draft angle to provide an outside vertical force component in the cap and sealing ring. The vertical force locks the protrusions into the respective recess and provides a positive sealing force to the sealing ring when the cap is twisted into the snout and into the locking position. The two spiral grooves increase the caps resistance to backing out and create symmetric force components which act on the cap. Furthermore, at the entrance of each groove, a lead-in angle is used to free the cap from the cover by continuing to turn the cap in a counter-clockwise motion.

The aforementioned objects and advantages, as well as others will become apparent from the following detailed description when read in light of the several figures.

BRIEF DESCRIPTION OF THE DRAWINGS

FIG. 5 is a bottom view of the oil fill cap in accordance with the preferred embodiment of the present invention.

FIG. 6 is a cross-sectional view of the oil fill cap of FIG. 1 taken along line VI—VI of FIG. 1.

FIG. 7 is a cross-sectional view of the oil fill cap of FIG. 1 in position in a crankcase cover.

DETAILED DESCRIPTION OF PREFERRED EMBODIMENTS

Figure 1:
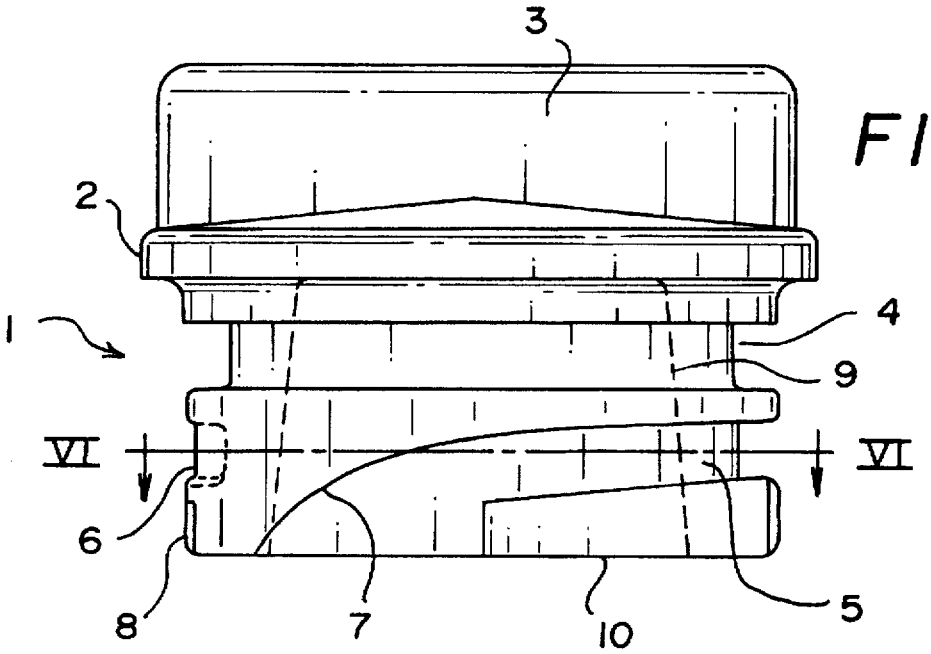
FIG. 1 is a side elevational view of an oil fill cap in accordance with a preferred embodiment of the present invention.
Figure 2:
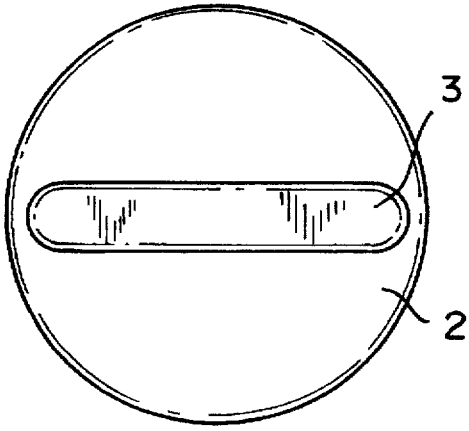
FIG. 2 is a top view of the oil fill cap in accordance with the preferred embodiment of the present invention.

FIG. 1 of the drawings illustrates an oil fill cap 1 for sealing of the oil fill snout of an internal combustion engine. The upper portion of the cap 1 comprises a disc-shaped end portion 2 that is molded into the lower cylindrical-shaped portion 8 of the cap 1. A handle 3 protrudes vertically from and extends across the disc-shaped end portion 2, as illustrated in FIG. 2. The handle 3 allows a user to apply an increased torque on the cap 1 to create a strong seal between the cap 1 and a complementary receiving portion of an oil fill snout. This stronger seal is necessary to adequately seal high pressure gases within the crank case and ensure that the cap will not loosen due to the vibration of the internal combustion engine.

An outer circumferential groove 4 is positioned directly below the disc-shaped end portion 2 of the cap 1 and extends around the lower cylindrical portion 8 of the cap 1. The outer circumferential groove 4 is designed to receive a sealing ring, such as, an 'O' ring 20, as shown in FIG. 7. Crank case covers that are designed to receive the cap 1 include draft angles on the oil fill snouts. The angled crank case cover walls create a vertical or axial force component on the sealing ring 20 to further create a strong seal.

Figure 3:
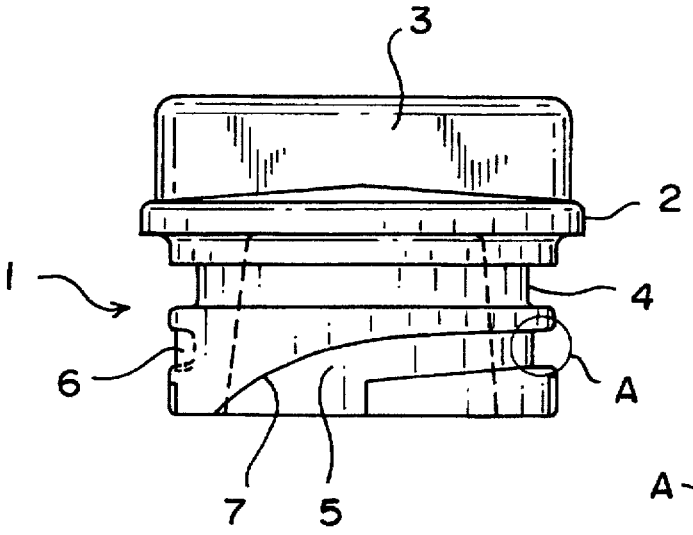
FIG. 3 is a side elevational view of the lead-in angle portion of one of the oil fill cap spiral grooves with a insert view of the spiral groove.
Figure 3A:
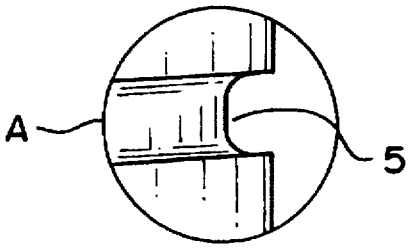
FIG. 3A is an expanded view of the encircled Section A of FIG. 3.
Figure 4:
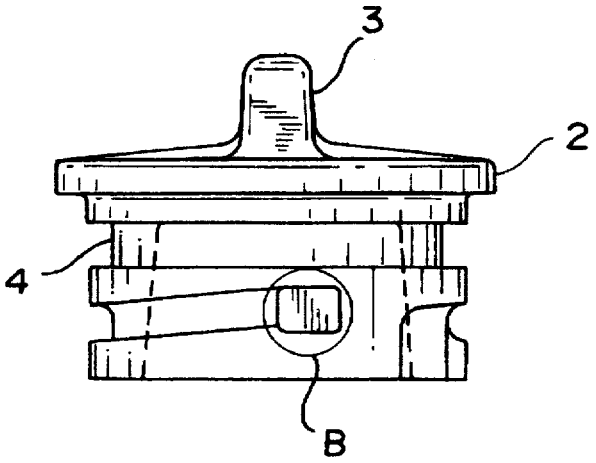
FIG. 4 is a side elevational view of the locking recess portion of one of the spiral grooves of the oil fill cap.
Figure 4A:
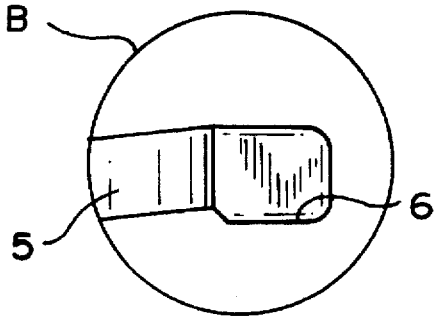
FIG. 4A is an expanded view of the encircled Section B of FIG. 4.

In accordance with the preferred embodiment, two spiral grooves 5 extend upwardly from a bottom edge 10 of the cylindrical-shaped portion 8 of the cap 1 and extend just below the outer circumferential groove 4, as illustrated in FIG. 3. By providing two grooves 5, symmetrical force components are created on the cap 1 to ensure a tight seal under all ambient conditions in that resistance to movement of the cap 1 is increased. At the end of each spiral groove 5 is a recess 6 which provides a locking means for the cap 1. As can be seen from FIG. 4 and 4A, the recess 6 is designed to receive a respective dimple or protrusion 16 of the complimentary receiving portion of the crank case cover, which passes along the spiral groove 5, as illustrated in FIG. 7. The vertical force created by the angled walls of the crank case cover locks the cap into the recess 6 at the end of the spiral groove. Therefore, the recess 6 and the respective protrusion 16 form a positive lock to hold the cap in place and to create an effective seal. The positive lock is broken by pushing the cap 1 inward and then turning the cap 1 counter-clockwise until the cap is separated from the crank case cover. These features will be discussed in greater detail hereinbelow with respect to FIG. 6.

The entrance of each spiral groove 5 includes a lead-in or helical angle 7 that forces the cap 1 off of the protrusion 16 of crank case cover as the cap is turned counter clock-wise. Other designs require the cap to be "wiggled" free from the crank case cover which could require a considerable effort because of the cap location. The lead-in angle 7 of the current design alleviates this problem by forcing the cap off of the crank case cover completely by turning the cap in a counter-clockwise motion. The lead-in angle 7 also allows for the cap to be inserted into the receiving crank case cover with relative ease due to the large entrance way of the spiral threads 5. A bottom view illustrating the entrance of the spiral grooves 5 on the cap 1 is illustrated in FIG. 5.

The cylindrical body portion 8 is hollow and comprises angular inner walls 9. The hollow cavity 10 and angular inner walls 9 of the cap 1 are designed to accommodate the oil fill snout 12 of the receiving crank case cover to further create a strong seal, as illustrated in FIG. 7. Moreover, the cap 1 is lighter in weight and easier to handle due to the hollow cavity 10 in the lower cylindrical portion of the cap 1.

As can be seen from FIG. 6, the helical grooves 5 extend over less than one half of the circumference of the cap 1 and include detents 14 adjacent the end of the helical groove 5. The detents 14 and recesses 6 cooperate to secure the protrusion 16 of the crank case cover 18 in place as illustrated in FIG. 7. As discussed hereinabove, the crank case cover includes angled oil fill snout 12 which extends into the hollow cavity 10 and presses against the inner surface 9 of the cap 1. Because the snout 12 is angled, the cap 1 cooperates with the snout 12 and opposing wall 22 so as to provide a vertical force component on the sealing ring 20. In doing so, not only is a strong seal created between the cap 1 and the wall 22 to secure the cap against vibrating, a releasing force is created to aid in removal of the cap.

Figure 8A:
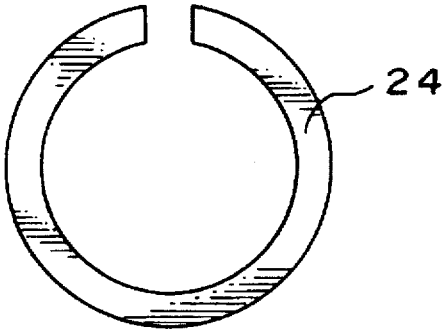
FIG. 8A is a top view of a wave ring used in conjunction with the oil fill cap illustrated in FIG. 1.
Figure 8B:
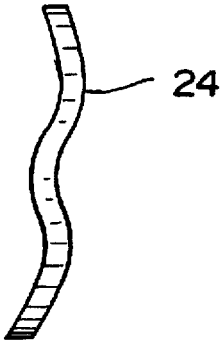
FIG. 8B is a side view of the wave ring illustrated in FIG. 8A.

Oftentimes when the cap 1 is secured within the crankcase cover as illustrated in FIG. 7, the cap can appear "cocked" in the cover. This appearance is created due to the fact that the protrusions 16 of the crankcase cover form an axis therebetween and the cap is free to rotate about such axis. In order to maintain the cap in alignment, a wave ring 24 is positioned below the disc shaped end portion 2 of the cap 1 as illustrated in FIG. 7. The wave ring 24, illustrated in detail in FIGS. 8A and 8B is in the form of a serpentine washer which applies an upward force to the underside of the disc shaped end portion 2 in order to hold the cap 1 in a level position.

Again, when the cap 1 is to be removed, the cap 1 is initially pushed inwardly to raise the protrusion 16 above the recess 6 and subsequently rotated to allow the protrusion 16 to pass through the groove 5 to release the cap. Again, the cap 1 is completely removed from the crank case with ease due to the lead-in angles.

While the present invention has been described with reference to a preferred embodiment, it should be appreciated by those skilled in the art that the invention may be practiced otherwise than as specifically described herein without departing from the spirit and scope of the invention. It is therefore, understood that the spirit and scope of the invention be limited only by the appended claims.

INDUSTRIAL APPLICABILITY

The oil fill cap may be employed in any environment where it is essential for a cap to provide a strong seal that is able to withstand high gas pressures and continuous vibration to eliminate gas leakage and cap loss. This particular oil fill cap is even more appropriate in an environment where a fill cap is used constantly by an operator, thus, coupling the need for reliable sealing characteristics with easy cap removal.

What is claimed is:

1. A cap for sealing an opening of a container comprising:

a cylindrical body portion having a disc-shaped end portion at one end;

a handle means for manipulating the body portion protruding from said disc-shaped end portion;

an outer circumferential groove positioned adjacent said disc-shaped end portion and extending circumferentially around said cylindrical body portion for receiving a sealing ring;

at least one spiral groove extending circumferentially around a portion of said cylindrical body portion;

a lock formed in said spiral groove for securing said cap onto a complementary portion of the container; and wherein said spiral groove includes an angular means for forcing said cap off of said complementary portion by turning said cap for removal.

2. The cap as defined in claim 1, wherein the cap is made from an injection molded plastic.

3. The cap as defined in claim 1, further comprising an alignment means for aligning the cap with respect to the container.

4. The cap as defined in claim 3, wherein said alignment means includes a biasing means for contacting said disc-shaped end portion and the container when the cap is in a closed position.

5. The cap as defined in claim 1, wherein said cylindrical body portion comprises an inwardly tapered cavity extending from an end of the cap opposite said disc-shaped end portion.

6. The cap as defined in claim 5, wherein said inwardly tapered cavity includes an angled wall.

7. The cap defined in claim 6, wherein a vertical force component is provided on said sealing ring when said cap is secured to said opening of a container.

8. The cap as defined in claim 7, wherein said spiral grooves further include a lead-in angle extending from the end of the cap opposite said disc-shaped end portion.

9. The cap as defined in claim 8, wherein said spiral groove comprises a recess positioned near the end of said spiral groove.

10. The cap as defined in claim 9, wherein said lock includes said recess for receiving said complementary portion of the container to lock said cap onto the container.

11. A cap for sealing an opening in an oil reservoir comprising;

a cylindrical body portion having a first closed end and a second open end;

at least one circumferential groove formed in an outer surface of said body portion adjacent said first end for receiving a sealing means for sealing against the opening;

at least one spiral groove formed in an outer surface of said body portion, said spiral groove commencing at said second end of said body portion and terminating adjacent said circumferential groove; and at least one recess formed in said spiral groove for receiving a protrusion extending from the opening of the oil reservoir for securing the cap in a closed position.

12. The cap as defined in claim 11, further comprising an alignment means for aligning the cap with respect to the opening.

13. The cap as defined in claim 12, wherein said alignment means includes a biasing means for contacting a disc-shaped end portion forming the closed end of said cylindrical body portion and the opening when the cap is in a closed position.

14. The cap as defined in claim 11, wherein said cylindrical body portion comprises a tapered inner surface and includes force means for creating an axial force component against said sealing means.

15. The cap as defined in 14, wherein said tapered inner surface of said cylindrical body portion tapers inwardly from said second end towards said first end.

16. The cap as defined in claim 15, further comprising a detent means formed in said spiral groove adjacent said recess for engaging the protrusion of the opening of the oil reservoir.

* * * * *